US005367794A

United States Patent [19]

Adelstein et al.

[11] Patent Number: 5,367,794

[45] Date of Patent: Nov. 29, 1994

[54] CLEATED SHOE PROTECTOR

[76] Inventors: Stephen Adelstein; Terence D. Kindle, both of 425 Martin Rd., Bonny Doon, Calif. 95060

[21] Appl. No.: 240,812

[22] Filed: May 11, 1994

Related U.S. Application Data

[63] Continuation of Ser. No. 41,657, Apr. 1, 1993, abandoned.

[51] Int. Cl.[5] ..... A43B 1/10; A43B 5/00

[52] U.S. Cl. ..... 36/135; 36/7.5

[58] Field of Search ..... 36/7.5, 135, 127, 7.6, 36/7.1 R

[56] References Cited

U.S. PATENT DOCUMENTS

| | | | |
|---|---|---|---|
| 1,851,778 | 3/1932 | Skillen | 36/7.5 |
| 2,076,316 | 4/1937 | Beals, Jr. | 36/135 |
| 2,894,338 | 7/1959 | Scholl | 36/11.5 |
| 3,812,603 | 5/1974 | Goodman . | |
| 3,821,858 | 7/1974 | Haselden | 36/135 |
| 3,913,243 | 10/1975 | Arnold et al. | 36/135 |
| 4,258,483 | 3/1981 | Hogue | 36/135 |
| 4,314,412 | 2/1982 | Anderson et al. . | |
| 4,387,515 | 6/1983 | Baldwin | 36/135 |
| 4,484,398 | 11/1984 | Goodwin et al. . | |
| 4,825,563 | 5/1989 | Strongwater | 36/7.1 R |
| 5,014,448 | 5/1991 | Perrone . | |
| 5,070,631 | 12/1991 | Fenton . | |
| 5,172,496 | 12/1992 | Vemi | 36/135 |

FOREIGN PATENT DOCUMENTS

| | | | |
|---|---|---|---|
| 2520988 | 8/1983 | France | 36/135 |
| 2621227 | 4/1989 | France | 36/135 |
| 2140273 | 11/1984 | United Kingdom | 36/135 |

*Primary Examiner*—Steven N. Meyers
*Attorney, Agent, or Firm*—Richard C. Litman

[57] ABSTRACT

A protector worn over a cleated shoe. A two layered sole includes a deformable upper layer and a non-deformable lower layer. Right and left upper sections wrap around the cleated shoe, one upper section partially overlying the other, and mutually attaching by hook and loop material. Each upper section is generally configured as an inverted V, attaching at two points to the sole. At the point of the V, two parallel attaching strips overlie or underlie corresponding strips, these strips bearing interlocking hook and loop material. Cleats on the shoe sink into the upper, deformable sole layer. A low wall built into the protector sole at the heel retains the shoe heel thereon.

7 Claims, 2 Drawing Sheets

CLEATED SHOE PROTECTOR

CROSS REFERENCE TO RELATED APPLICATIONS

This application is a continuation of application Ser. No. 08/041,657 filed on Apr. 1, 1993 now abandoned.

BACKGROUND OF THE INVENTION

1. FIELD OF THE INVENTION

The present invention relates to a cover to be worn over a cleated shoe, so that neither cleats nor floors will be damaged.

2. DESCRIPTION OF THE PRIOR ART

Protective covers for mitigating damage, as to floor surfaces, from cleats are known. U.S. Pat. No. 3,812,603, issued on May 28, 1974 to Mallard S. Goodman, discloses a cover having a sole and cords or straps for tying around the cleated shoe. In an alternative embodiment, the sole comprises a deformable upper layer bonded to a more rigid layer, cleats seating in depressions formed in the deformable layer.

Attachment of right and left sides of upper portions of a protector by overlying patches of hook and loop material is seen in U.S. Pat. Nos. 4,314,412 and 5,014,448, issued respectively to Blair V. Anderson et el. on Feb. 9, 1982, and to Michael A. Perrone on May 14, 1991. The upper portion disclosed by Anderson et el. partially encloses the heel, and attaches to its sole along a single, unrelieved line on each side, both characteristics being unlike the present invention. The Perrone invention provides a rear wall enclosing the heel, and the upper is formed from a single piece of material continuously attached to the sole along a line of contact therewith.

Other shoe protectors are seen in U.S. Pat. Nos. 4.484,398, issued to Boyd G. Goodwin et el. on Nov. 27, 1984, and 5,070,631, issued to James R. Fenton on Dec. 10, 1991. The protector of each respective patent lacks an upper portion and a two layered, deformable sole, and the protector of Goodwin et al. lacks an upper portion.

None of the above inventions and patents, taken either singly or in combination, is seen to describe the instant invention as claimed.

SUMMARY OF THE INVENTION

The present invention provides a protective cover which is readily donned and doffed, is comfortable and fits securely over its associated cleated shoe, and is foldable for compact storage. The protective cover protects floors, cleats which are prone to breaking, and provides improved adhesion on slippery surfaces.

A shortcoming in the prior art is that while protective covers mitigate damage due to cleats, the combined cleated shoe and protective cover form an awkward mass which frequently fails to provide a confident impression of secure attachment and which may be uncomfortable to wear.

The novel shoe protector has a two layered sole including a deformable upper layer and a non-deformable lower layer. The upper layer receives cleats, forming depressions when the wearer's weight bears on the cleats. The lower layer has the wear and support characteristics of a convention shoe sole. The two layers combine to absorb and diffuse force which would otherwise bear on a finished floor. The sole also includes a clearly defined heel, and has a low, U-shaped wall to retain the heel of the cleated shoe. The defined heel provides comfortable distribution of weight, so that the shoe protector better simulates a conventional shoe. The low wall retains the heel of the cleated shoe in overlying relationship with the sole of the inventive shoe protector. Thus, the wearer is confident that the cleated shoe will not slip with respect to the shoe protector. In certain situations, such as driving a car, wherein a wearer's foot is inclined as it engages pedals, a cleated shoe would be particularly prone to slipping.

The upper portion of the shoe protector is formed from flexible material which attaches to the sole at two points on each side. This minimizes mass of the upper portion, provides an opening for breathing in what would otherwise be an unrelieved wall, and still anchors the right or left side of the upper portion at widely spaced points. Because these two points are in line, the upper portion can be folded over so as to be quite compact.

The upper portion includes corresponding strips of material having hook and loop material which overlie one another when attaching the shoe protector over a cleated shoe. Preferably, there are two pairs of overlying strips to provide adjustability of tightness and appropriate positioning of attachment strips over different sized cleated shoes.

Accordingly, it is a principal object of the invention to provide a shoe protector for a cleated shoe which prevents contact of cleats with a floor surface.

It is another object of the invention to provide a shoe protector for a cleated shoe which has a deformable surface to receive and accommodate cleats.

It is a further object of the invention to provide a shoe protector for a cleated shoe which grips a cleated shoe securely.

Still another object of the invention is to provide a shoe protector for a cleated shoe which maintains the heel of a cleated shoe in overlying relationship to the sole of the shoe protector.

An additional object of the invention is to provide a shoe protector for a cleated shoe which is adjustable as to tightness.

Yet a further object of the invention is to provide a shoe protector for a cleated shoe which securely grips different sized cleated shoes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
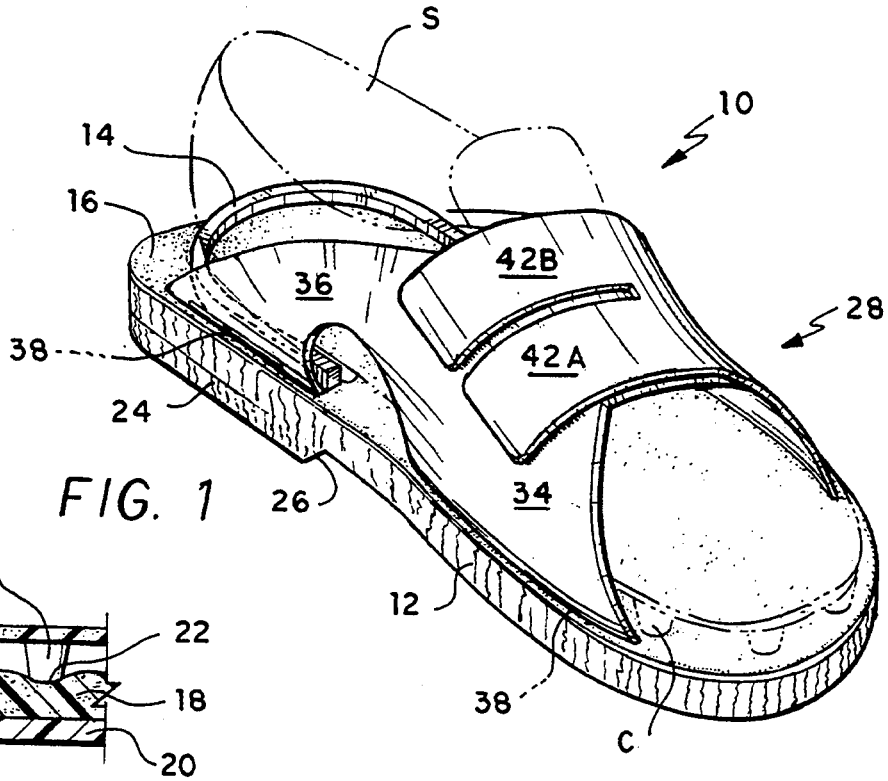
FIG. 1 is a perspective view of the invention.

The present invention 10 is seen in FIG. 1 as it engages a cleated shoe S. The shoe protector 10 has a sole 12 including a low wall 14 located on the sole upper surface 16, partially surrounding the heel of the cleated shoe S. The wall 14 is high enough to cause interference preventing the cleated shoe S from sliding on sole 12, but sufficiently low to allow a wearer to raise the heel of shoe S to clear wall 14 while the toe of shoe S still occupies its original position. Wall 14 preferably includes a left wall 142, a right wall 144 and a rear wall 146 to partially surround the heel or rear cleats of shoe S. Left wall 142 and right wall 144 are spaced inwardly from the rear end of the shoe protector.

Figure 2:
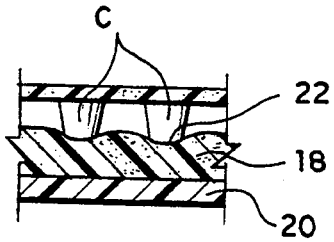
FIG. 2 is a cross sectional detail view of the sole of the invention.

With reference to FIG. 2, internal construction of sole 12 is shown to include a deformable upper layer 18 and a non-deformable lower layer 20. When a wearer (not shown) puts his or her weight on the cleated shoe S, cleats C form depressions 22 in the sole upper layer 18. These depressions 22 effectively interlock cleated shoe S to shoe protector 10 while the wearer's weight bears thereon. The continuous deformable layer 18 thus accommodates any pattern of cleats C.

The sole 12 also includes a clearly defined heel 24 having a front wall 26.

Figure 3:
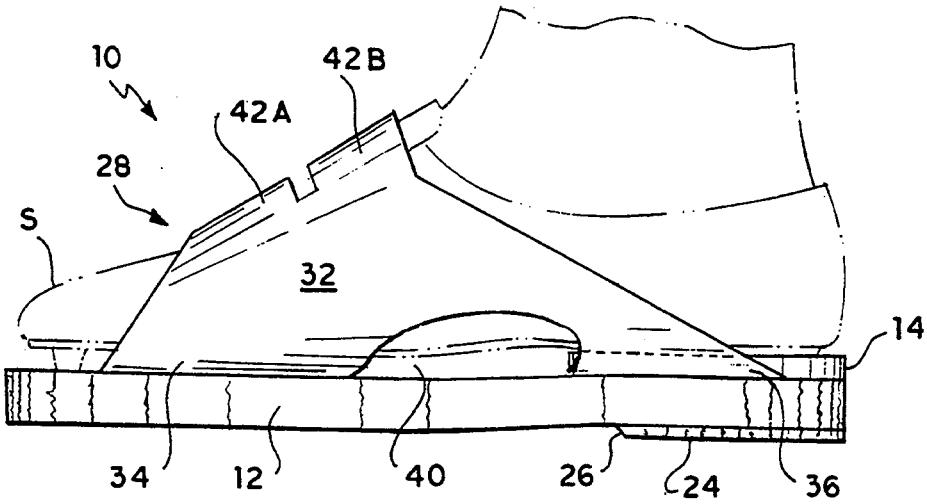
FIG. 3 is a side elevational view of the invention.
Figure 4:
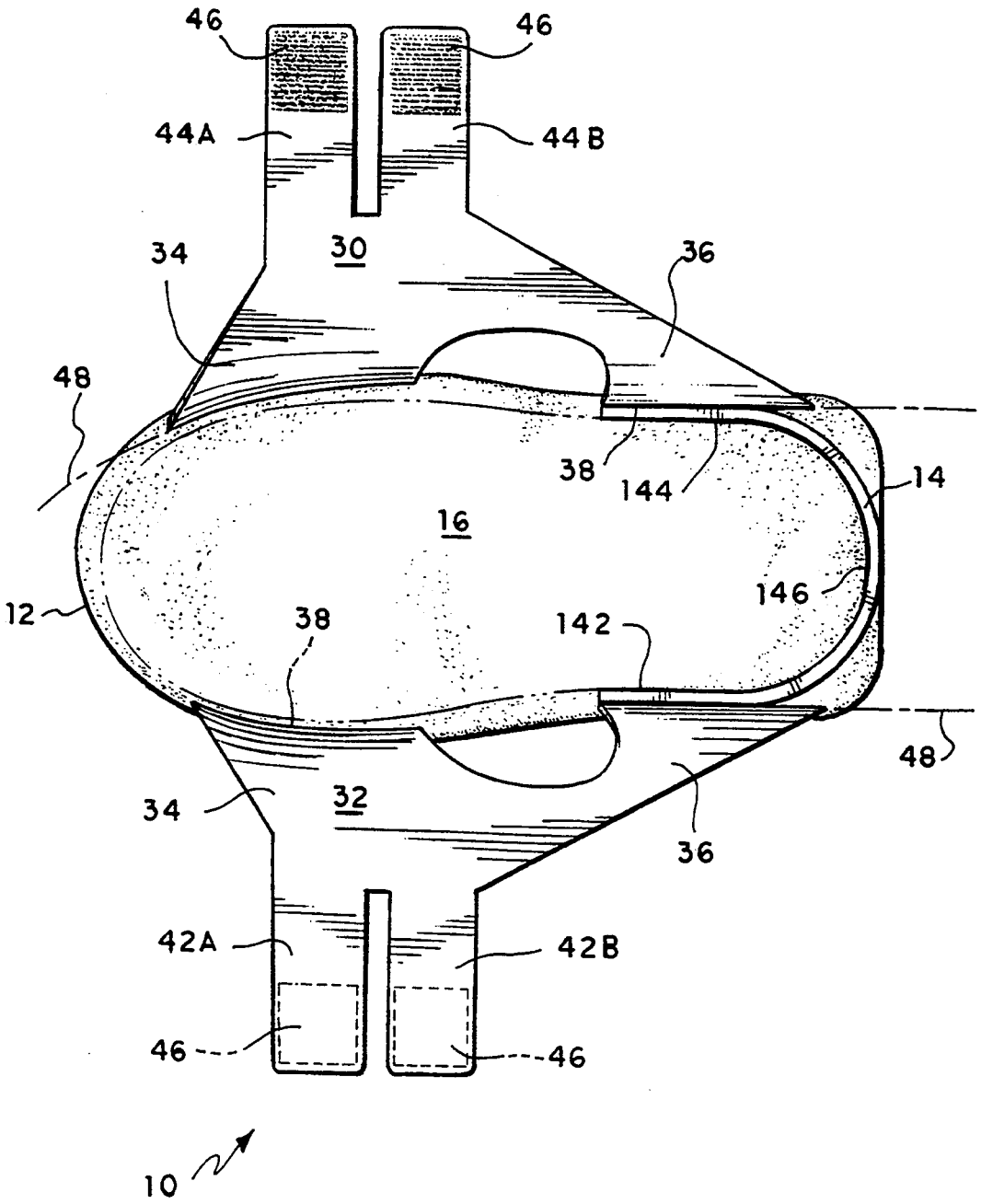
FIG. 4 is a top plan view of the invention.

The upper portion 28 of the shoe protector 10 is formed in cooperating right and left sides 30,32, better seen in FIG. 4. Each side 30 or 32 is configured roughly as an inverted V, the point of the V providing an attachment point, and the metatarsal strip 34 and the heel strip 36 form the legs 34,36 of the V attaching to sole 12. Preferably, legs 34,36 are inserted into slots 38 formed in sole 12, and penetrate at least one inch (2.5 cm) therein. An opening 40 (see FIG. 3) is defined between front and rear legs 34,36 and sole 12. Preferably, each metatarsal strip 34 is attached along an edge of the metatarsal region of sole 12, and each heel strip is attached along an edge of sole 12 between the heel to the rear end of sole 12. When sides 30 and 32 are secured together, a heel opening and a toe opening is defined therebetween.

Securement of shoe protector 10 over the upper metatarsal portion of cleated shoe S is enabled by overlying attachment strips 42A,42B,44A,44B. Attachment strips 42A,44A or 42B,44B adhere to one another because of corresponding hook and loop material 46. Two upper and two lower attachment strips 42A,42B,44A,44B enable adjustment for cleated shoes of differing dimensions. When one set of upper and lower attachment strips 42A,44A are connected first and the second set of attachment strips 42B,44B is connected thereafter, tightness of fit can be adjusted in fine increments to a wearer's satisfaction.

The depiction of FIG. 4 shows upper portion right and left sides 30,32 folded outwardly. Right and left sides 30,32 can also be folded inwardly for compact storage. Folding is facilitated in part because of the orientation of legs 34,36. Legs 34,36 substantially form a line 48 of contact with sole 12 which line 48 is substantially straight, allowing for the contour of a cleated shoe, but sufficiently straight to enable folding of one upper portion side 30 or 32 in the manner of a flap.

The novel shoe protector 10 thus provides desired protection of floor surfaces (not shown) which are subject to damage by cleats C, while still providing comfort and security of close fit. The novel shoe protector 10 is readily donned, doffed, and folded for storage.

It is to be understood that the present invention is not limited to the sole embodiment described above, but encompasses any and all embodiments within the scope of the following claims.

We claim:

1. A cleated shoe protector comprising:

a sole having an upper stratum made from deformable material, said upper stratum having an upper surface, a rear end, a metatarsal region, and a front end, a lower stratum made from non-deformable material, a heel having vertical front wall depending from said lower stratum, and a low wall having a left wall, a right wall and a rear wall, said low wall being located on said upper surface at said rear end, wherein said right wall and said left wall are spaced substantially inwardly from said rear end, whereby said low wall partially surrounds a cleated shoe heel; and an upper shoe protector portion for substantially covering an upper metatarsal portion of the cleated shoe, said upper shoe protector portion including right and left sides made from flat material, one of said right and left sides having an attachment base including attachment means and the other of said right and left sides having at least one attachment strip maneuverable to overlie said attachment base, said attachment strip having a corresponding attachment means, wherein each of said upper right and left sides further includes a metatarsal strip and a heel strip connecting to said sole, wherein each said metatarsal strip is attached along an edge of said metatarsal region of said sole, and each said heel strip is attached along an edge of said sole proximate to the region defined from said heel to said rear end, whereby said metatarsal strip and said heel strip define a lateral archway opening therebetween with said sole, and wherein said upper right and left sides are capable of being secured together by said attachment base and said attachment strip to define a heel opening and a toe opening therebetween.

2. The cleated shoe protector according to claim 1, each of said upper right and left sides being made from flexible material, whereby said shoe protector is folded substantially flat when not in use.

3. The cleated shoe protector according to claim 1, wherein said attachment means and said corresponding attachment means comprise hook and loop material.

4. The cleated shoe protector according to claim 3, each of said upper right and left sides being made from flexible material, whereby said shoe protector is folded substantially flat when not in use.

5. The cleated shoe protector according to claim 4, wherein said at least one attachment strip comprises two parallel attachment strips, each of said two parallel attachment strips attaching independently to said attachment base, whereby tightness of fit of said shoe protector is adjusted and accommodation for cleated shoes of different dimensions is enabled.

6. The cleated shoe protector according to claim 1, wherein said at least one attachment strip comprises two parallel attachment strips, each of said two parallel attachment strips attaching independently to said attachment base, whereby tightness of fit of said shoe protector is adjusted and accommodation for cleated shoes of different dimensions is enabled.

7. The cleated shoe protector according to claim 1, wherein said at least one attachment strip comprises two parallel attachment strips, each of said two parallel attachment strips attaching independently to said attachment base, and said attachment base comprises two parallel attachment base strips, whereby one of said attachment strips attaches to one of said two parallel attachment base strips, and the other of said attachment strips attaches to the other of said two parallel attachment base strips, whereby tightness of fit of said shoe protector is adjusted.

* * * * *